US010094302B2

(12) United States Patent
Busse

(10) Patent No.: US 10,094,302 B2
(45) Date of Patent: Oct. 9, 2018

(54) CENTRAL LOCKING FOR A CAMSHAFT ADJUSTER

(71) Applicant: Schaeffler Technologies AG & Co. KG, Herzogenaurach (DE)

(72) Inventor: Michael Busse, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 100 days.

(21) Appl. No.: 15/323,120

(22) PCT Filed: Mar. 19, 2015

(86) PCT No.: PCT/DE2015/200176
§ 371 (c)(1),
(2) Date: Dec. 30, 2016

(87) PCT Pub. No.: WO2016/000692
PCT Pub. Date: Jan. 7, 2016

(65) Prior Publication Data

US 2017/0159579 A1 Jun. 8, 2017

(30) Foreign Application Priority Data

Jun. 30, 2014 (DE) ..... 10 2014 212 617

(51) Int. Cl.
*F01L 1/344* (2006.01)
*F02D 13/02* (2006.01)

(52) U.S. Cl.
CPC ..... *F02D 13/0249* (2013.01); *F01L 1/3442* (2013.01); *F01L 2001/3443* (2013.01);
(Continued)

(58) Field of Classification Search
CPC ..... F01L 2001/3443; F01L 2001/34463; F01L 2001/34466; F01L 13/04; F01L 2760/001; F01L 2800/01
(Continued)

(56) References Cited

U.S. PATENT DOCUMENTS 6,684,835 B2 2/2004 Komazawa
8,627,793 B2 1/2014 Takada
(Continued)

FOREIGN PATENT DOCUMENTS

DE 102008059196 6/2010
DE 102012013518 1/2013
(Continued)

*Primary Examiner* — Jorge Leon, Jr.
(74) *Attorney, Agent, or Firm* — Davidson, Davidson & Kappel, LLC

(57) ABSTRACT

A hydraulic camshaft adjuster for changing the control times of gas exchange valves of an internal combustion engine, designed as a vane cell camshaft adjuster. A control device inserted in the vane selectively opens and interrupts a flow connection between the working chambers. A locking device prevents relative motion between the rotor and the stator in that the rotor is fastened to the stator at a vane position. A switching valve, which has three working ports, a P port and a T port, can be moved into different control positions by an adjusting element,—wherein in the control position, the P port communicates with the working chambers via the A port, the B port is blocked at the switching valve, and the T port communicates with the control device of the vanes via the C port. In a control position provided as a starting strategy for the switching valve the A port communicates with the P port and the working chambers, the B port communicates with the T port and the working chambers, and the C port communicates with the control device of the vanes and the T port.

8 Claims, 3 Drawing Sheets

(52) U.S. Cl.
CPC ..... *F01L 2001/34426* (2013.01); *F01L 2001/34456* (2013.01); *F01L 2001/34463* (2013.01); *F01L 2001/34466* (2013.01); *F01L 2001/34483* (2013.01); *F01L 2800/01* (2013.01)

(58) Field of Classification Search
USPC ..... 123/90.15, 90.17
See application file for complete search history.

(56) References Cited

U.S. PATENT DOCUMENTS

| | | | | |
|---|---|---|---|---|
| 8,820,280 | B2 | 9/2014 | Smith | |
| 2002/0078913 | A1 | 6/2002 | Fukuhara | |
| 2013/0008397 | A1* | 1/2013 | Takada | F01L 1/34 123/90.11 |
| 2013/0104820 | A1* | 5/2013 | Watanabe | F01L 1/3442 123/90.15 |
| 2015/0059671 | A1* | 3/2015 | Mukaide | F01L 1/3442 123/90.15 |
| 2016/0084120 | A1* | 3/2016 | Sato | F01L 1/3442 123/90.17 |
| 2016/0108770 | A1* | 4/2016 | Kobayashi | F01L 1/3442 123/90.17 |
| 2016/0230614 | A1* | 8/2016 | Scheidig | F01L 1/3442 |
| 2017/0022854 | A1* | 1/2017 | Takada | F01L 1/3442 |

FOREIGN PATENT DOCUMENTS

| | | |
|---|---|---|
| DE | 112011102940 | 7/2013 |
| DE | 102013207615 | 10/2014 |
| WO | WO2012/094324 | 7/2012 |

* cited by examiner

CENTRAL LOCKING FOR A CAMSHAFT ADJUSTER

BACKGROUND

Camshaft adjusters of this type are used to change the timing of gas exchange valves of an internal combustion engine during engine operation for the purpose of improving the consumption values and the operating behavior of the internal combustion engine.

One specific embodiment, which has been proven and tested in practice, is a camshaft adjuster designed as a vane adjuster, including a stator and a rotor which delimit an annular space, which is divided into two working chambers by vanes. A hydraulic medium may be optionally applied to the working chambers, which is supplied to the working chambers on one side of the vanes of the rotor from a pressure medium reservoir in a pressure medium circuit via a pressure medium pump, and which is fed back into the pressure medium reservoir from the working chambers on the particular other side of the vanes. The working chambers whose volume is increased have an operating direction which is opposite the operating direction of associated opposite working chambers. Due to the operating direction, a rotation of the rotor relative to the stator may be triggered in the clockwise or counterclockwise direction. The control of the pressure medium flow, and thus the adjusting movement of the camshaft adjuster, includes a hydraulic multi-way switching valve, with the aid of which flow-through openings may be blocked or unblocked as a function of a position of a valve body.

One problem with these camshaft adjusters is that they are not yet fully filled with pressure medium in a start phase or have not yet been emptied. When the engine starts, if the oil pressure within the internal combustion engine has not yet been built up, the alternating torques applied by the camshaft may trigger uncontrolled movements of the rotor with respect to the stator, which may result in increased wear and an undesirable noise development. To avoid this problem, it is known to provide a locking device between the rotor and the stator, which locks the rotor when the internal combustion engine is turned off in a rotation angle position with respect to the stator which is favorable for startup.

Locking devices of this type preferably include spring-loaded locking pins, which successively lock into locking gates provided on the sealing cover or the stator when the rotor rotates. Before a central locking position is reached, a rotation of the rotor in the direction of the central locking device is possible, but a rotation of the rotor in the opposite direction is blocked. After the internal combustion engine has warmed up and/or the camshaft adjuster has been completely filled with pressure medium, the locking pins are forced out of the locking gates, actuated by the pressure medium, so that the rotor is subsequently able to properly rotate with respect to the stator to adjust the rotation angle position of the camshaft.

A control device assigned to the vanes is also known, whose control pins are positioned in the vane separating the working chambers. A fluidic connection of two oppositely acting working chambers may be established with the aid of this control device. The control pins are moved against a spring force by the application of pressure medium. The control pins may be arranged in such a way that a fluidic connection between the working chambers is interrupted upon an application of pressure medium. When the internal combustion engine is turned off, both the spring-loaded locking pins of the locking devices and the control pins of the control device are placed from an unlocking position into an unpressurized locking position by the spring force.

A hydraulic camshaft adjuster designed as a vane adjuster is known from the publication U.S. Pat. No. 6,684,835 B2, whose central locking action takes place when the engine is turned off. An electronic control unit detects a signal which is generated when the engine is turned off as well as signals that represent the status of the stator relative to the rotor. An electrical control valve includes five ports, of which one port accommodates the oil inflow from the lubricating oil circuit of the engine or the pressure medium pump, one port connects the solenoid valve to all locking pistons or locking pins, and two ports connect the solenoid valve to working chambers A and B of the camshaft adjuster and one tank port is provided for the oil outflow from the solenoid valve.

SUMMARY OF THE INVENTION

An object of the present invention is to provide a starting strategy for the internal combustion engine, which makes it possible to lock the camshaft adjuster in the central locking position even during an active pressure medium adjustment.

The present invention provides a starting strategy of the internal combustion engine, which provides a hydraulic circuit, in which an additional, fifth control position is provided for the switching valve. In the additional control position, a flow connection exists between the A port and the P port and consequently between the pressure pump and working chambers A. The B port communicates with the T port and consequently with the oil or pressure medium reservoir and working chambers B. The C port connects the control device of the vanes to the T port. Five control positions, which are also to be referred to as piston positions, are thus provided for the switching valve according to the present invention which includes five connections or ports. A P port, or inlet port, is connected to a pressure pump, and a T port, or outlet port, is assigned to a tank or pressure medium reservoir. The A port forms a connection for the working chambers, and the B port is in contact with the working chambers. The additional C port is designated for the control device of the vanes. The additional, second control position of the control valve follows the first control position, which is approached when the engine stops and which is situated upstream from the third control position, in which the camshaft adjuster is adjustable to ADVANCE.

In this additional, second control position, the C port is connected to the T port or the tank, corresponding to the first control position. The locking gate of the locking device thus remains unpressurized, and at least one locking pin is able to engage with the locking gate. Deviating from the first control position of the switching valve, however, the B port is connected to the T port. The additional control position of the switching valve has a positive impact on the characteristic of the volume flow of the hydraulic medium. In the second control position, no oil or hydraulic medium yet flows into the hydraulic line connected to the C port. However, the working chamber is already connected to the T port, whereby the oil may be forced out of the working chamber. Consequently, the hydraulic pressure present in the working chamber effectuates an adjustment in the ADVANCE direction.

The starting strategy according to the present invention is advantageously characterized in that the hydraulic line connected to the C port is depressurized in the additional control position, whereby the locking pins engage into the locking gate unhindered. In addition, a disadvantageous adjustment of the camshaft adjuster past the central locking position in the ADVANCE direction is effectively prevented. With the aid of the starting strategy according to the present invention, the hydraulic camshaft adjuster may be adjusted into the central locking position and locked therein primarily during the shutdown operation of the internal combustion engine.

If the engine has stalled or if central locking is not possible for physical reasons, for example due to low ambient temperatures and the high oil viscosity associated therewith, the starting strategy according to the present invention ensures that the desired central locking action is achieved during the subsequent startup of the internal combustion engine. For this purpose, the hydraulic lines of the line system are switched in such a way that the pressure medium is able to flow out of a pressure medium chamber, which is used for acting upon the control and locking pins, into the pressure medium reservoir. In the unpressurized state of the hydraulic lines, the camshaft adjusters may be placed into the locking position and locked therein.

The starting strategy according to the present invention may be advantageously applied if the camshaft adjuster does not lock in a central locking position (CLP) in a start phase of the internal combustion engine and an angle position sets in between a RETARD end stop and the central locking position. In the start phase, the angle position of the camshaft may be determined after one camshaft revolution at the latest, for example with the aid of sensors in connection with a control unit of the internal combustion engine. For example, if the camshaft adjuster is then in the angle position between the RETARD end stop and the central locking position, the starting strategy according to the present invention is automatically initiated. A switching element, in particular an electromagnet of the switching valve, is then energized in such a way that it displaces a piston of the switching valve into the second control position.

According to the present invention, an arrangement of working ports on the switching valve is furthermore proposed, according to which the B port is placed in the center, the A port is placed on the right side and the C port is situated on the left side thereof. The port arrangement ensures an application of pressure onto the working chambers in the second control position, whereby the camshaft adjuster adjusts in the ADVANCE direction. In contrast thereto, in the previous port arrangement in connection with the four control positions of the switching valve, the camshaft adjuster adjusts to RETARD in the second control position and thus not in the direction of the central locking position.

As a measure for clearly limiting the actuations of the vane, the locking device furthermore has separate locking pins for an advance locking and for a retard locking. An inadvertent actuation of the vane into the ADVANCE working chamber as well as into the RETARD working chamber may be effectively prevented thereby.

For the operation of the locking device, it is advantageous if the locking pin designated for the advance locking disconnects a hydraulic line in a position extended from the rotor and consequently prevents a hydraulic flow in the direction of working chamber A. Accordingly, the locking pin designated for retard locking also disconnects a hydraulic line in a position extended from the rotor and thus interrupts a hydraulic flow acting upon working chamber B.

It is furthermore provided that all locking pins of the locking device are inserted in a spring-loaded manner. Pressure springs are preferably suitable therefor, whose particular spring force forces the relevant locking pin out of the rotor and into the locking gate in the absence of a counter-force. This measure ensures a failsafe adjustment of the camshaft adjuster even if the system pressure or the oil pressure is eliminated.

According to one advantageous embodiment, a first check valve is assigned to a hydraulic line assigned to a vane for the purpose of preventing a hydraulic flow from one working chamber into the additional working chamber, preferably for a hydraulic flow from the ADVANCE working chamber into the RETARD working chamber. Alternatively or additionally, a second check valve may be provided for the hydraulic line of another vane, which has a reverse operating direction from that of the first check valve. In the first of the two cases, a progression of the vane in the ADVANCE direction is achieved with the aid of the check valve, a progression in the RETARD direction being ensured in the second of the two cases.

A preferred structure of the camshaft adjuster in connection with the measure according to the present invention includes preferably four or more vanes for the purpose of achieving an optimum force distribution, which are situated on the rotor, distributed symmetrically over the circumference, and assigned to the pressure chambers.

BRIEF DESCRIPTION OF THE DRAWINGS

The present invention is explained in greater detail below on the basis of one preferred exemplary embodiment. Specifically.

DETAILED DESCRIPTION

Figure 1:
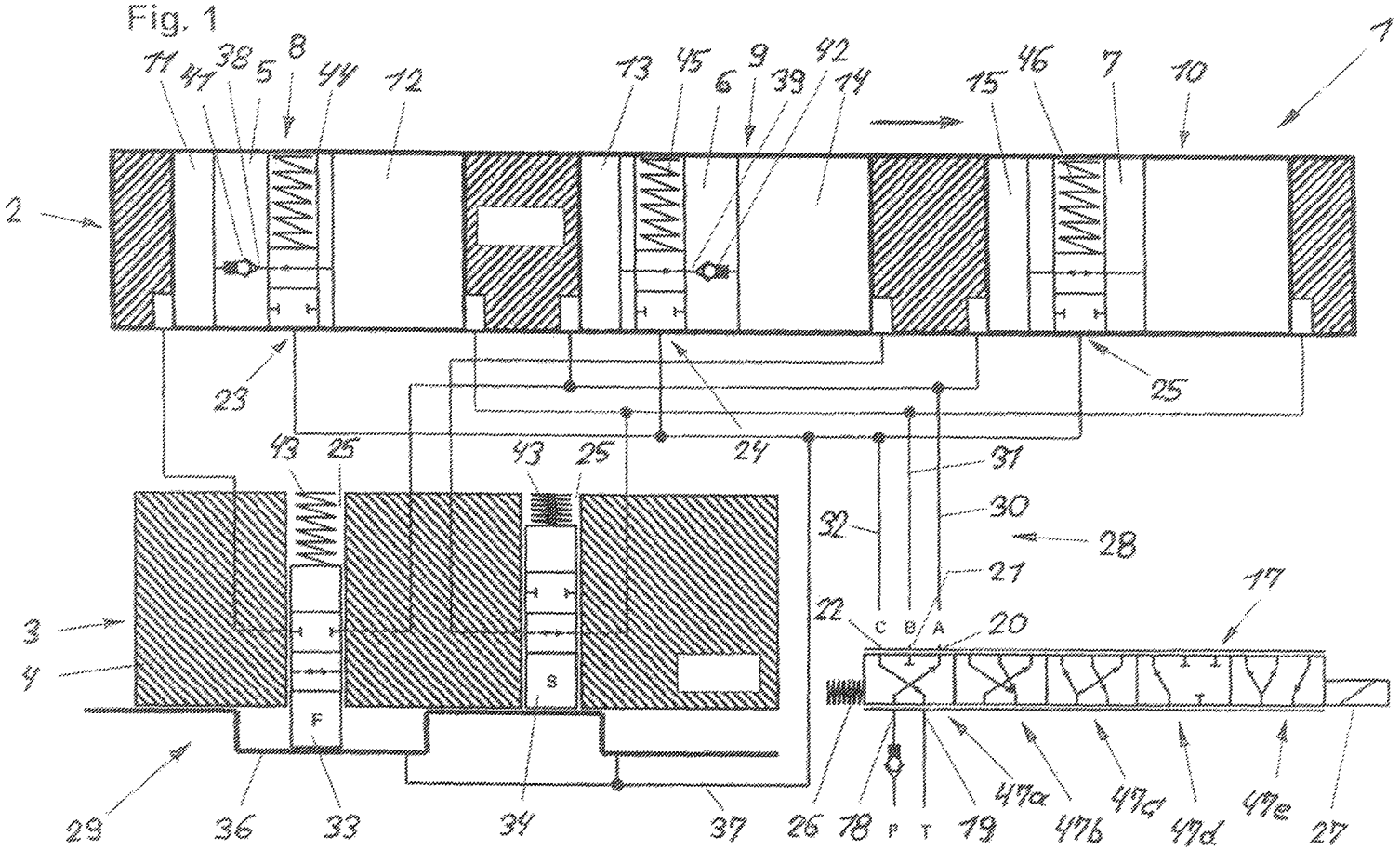
FIG. 1 shows a schematic representation of a camshaft adjuster according to the present invention.

A camshaft adjuster 1, having a known basic structure, is illustrated schematically in FIG. 1, which includes a stator 2, drivable by a crankshaft of an internal combustion engine, which is not illustrated, and a rotor 3, which is rotatably fixedly connected to a camshaft (not illustrated), including a rotor hub 4, and multiple vanes 5, 6, 7 oriented radially therefrom. Pressure chambers 8, 9, 10 are divided into working chambers 11 through 16 by vanes 5, 6, 7. The top illustration in FIG. 1 shows the vane adjuster in a developed view, while a detail of rotor hub 4 of rotor 2, including a locking device 29, is shown schematically at the lower left, and a switching valve 17, designed as a multi-way switching valve for controlling the pressure or hydraulic medium of camshaft adjuster 1, is shown schematically at the lower right. Switching valve 17 according to the present invention is a proportional valve, which includes five connections or ports as well as five control or piston positions 47*a* through 47*e*. A P port 18, or inlet port, is connected to a pressure pump, and a T port 19, or outlet port, is assigned to a tank or pressure medium reservoir. An A port 20 forms a connection for working chambers 11, 13, 15, and B port 21 is in contact with working chambers 12, 14, 16. Additional C port 22 is designated for control devices 23, 24, 25 of vanes 5, 6, 7. All ports are either switched open or closed, according to the control position of switching valve 17. Pressure is applied to switching valve 17 by a spring element 26, and an integrated piston is adjustable into the particular control or piston position as needed with the aid of a control element 27 preferably designed as an electromagnet.

FIG. 1 furthermore shows a hydraulic or pressure medium circuit, including a large number of pressure medium lines, which represents a hydraulic line system 28 between switching valve 17 and pressure chambers 8, 9, 10 as well as locking device 29. A hydraulic line 30 connects A port 20 directly to working chambers 13, 15. A branch of hydraulic line 30 is guided via locking device 29 to working chamber 11. Hydraulic line 31 establishes a connection between B port 21 and working chambers 12 and 16. Hydraulic line 31 runs to additional working chamber 14 via locking device 29. Hydraulic line 32 also connects C port 22 to all control devices 23 through 25 of vanes 5 through 7.

The rotation angle of the camshaft with respect to the crankshaft during normal operation, e.g., in the ADVANCE direction, is adjustable by the fact that pressure medium is applied to working chambers 11, 13, 15 via hydraulic line 30, whereby their volume is increased, while the pressure medium is simultaneously forced out of working chambers 12, 14, 16 and their chamber volume is consequently reduced. In FIG. 1, the ADVANCE direction is identified by an arrow, and the RETARD direction runs counter to the arrow direction. Working chambers 11, 13, 15, whose volume is increased in groups during the adjusting movement in the ADVANCE direction, are referred to as working chambers of one operating direction. The change in volume of working chambers 11, 13, 15 results in the fact that rotor 3, including vanes 5, 6, 7, is rotated with respect to stator 2. The volume of working chambers 12, 14, 16 may be increased by an application of pressure medium via B port 21 of switching valve 17 in connection with hydraulic line 31, while the volume of working chambers 11, 13, 15 simultaneously decreases due to a back-flow of the pressure medium via A port 20. This change in volume results in a rotation of rotor 3 with respect to stator 2, against the arrow direction in the RETARD direction.

Locking device 29 includes two locking pins 33, 34, which are also to be referred to as locking pinions, and which are linearly displaceable and inserted, spring loaded, into a receptacle 35 of rotor hub 4. Locking pins 33, 34 are arranged in the direction of a locking gate 36, spring-loaded by a spring element 43. Locking device 29 is released to facilitate the adjustment of rotor 3 with respect to stator 2. This takes place by applying pressure medium to locking gate 36, for which purpose pressure medium is supplied from C port 22 via hydraulic line 32 and another hydraulic line 37 in a corresponding control position of switching valve 17. Due to the application of pressure medium, locking pins 33, 34 are forced out of locking gate 36, so that rotor 3 is able to rotate freely with respect to stator 2.

Flow connections 38, 39, 40 are introduced into each of vanes 5, 6, 7, flow connections 38, 39 being assigned to a check valve 41, 42, which facilitates an overflow of the pressure medium or hydraulic medium from working chamber 12 into working chamber 11 or from working chamber 13 into working chamber 14. The flow of the pressure medium through flow connections 38, 39, 40 may be unblocked or blocked by switchable, control pins 44, 45, 46, to which spring force is applied. Switchable control pins 44, 45, 46, to which spring force is applied and which are assigned to control device 23, 24, 25, are each acted upon by pressure medium via hydraulic line 32 and are adjustable from a locking position into an unlocking position. In the unlocking position, the flow-through flow connection 38, 39, 40 is blocked, so that working chambers 11, 12; 13, 14 and 15, 16 are separated from each other.

According to first control position 47*a* of switching valve 17 illustrated in FIG. 1, locking pin 33 engages into locking gate 36, supported by spring element 43, this position corresponding to an ADVANCE stop position, in which locking pin 33 blocks a section of hydraulic line 30 and thus prevents a flow connection to working chamber 11. At the same time, engaged locking pin 34 opens a passage, so that a fluidic connection to working chamber 14 sets in via connected hydraulic line 31. Switching valve 17 according to the present invention may be adjusted in five control positions 47*a* through 47*e* by correspondingly energizing control element 27, whereby camshaft adjuster 1 is adjustable into different positions, for example in the direction of an ADVANCE adjustment or a RETARD adjustment.

The application of the starting strategy according to the present invention is provided for the event that camshaft adjuster 1 does not lock in a central locking position (CLP) in a start phase of the internal combustion engine. In the start phase, the controller of the internal combustion engine briefly detects the angle position of the camshaft, no later than after one revolution of the camshaft. If camshaft adjuster 1 is not locked in the central locking position (CLP) but rather, for example, in an angle position between a RETARD stop position and the central locking position, the starting strategy according to the present invention is automatically initiated. Switching valve 17 is energized in such a way that its piston approaches control position 47*b*, the second position. After a brief engine standstill, an oil pressure builds up relatively quickly in the internal combustion engine, so that oil as the hydraulic medium is applied to working chambers 13, 15 from P port 18 to A port 20 and via hydraulic line 30. At the same time, working chambers 14, 16 are connected to the tank or the pressure medium reservoir via hydraulic line 31, B port 21 and T port 19. Similar to control position 47*c*, the third piston position, camshaft adjuster 1 is adjusted into control position 47*c* in the direction of the arrow, i.e., in the ADVANCE direction.

In contrast to control position 47*c* but corresponding to control position 47*a*, C port 22 is connected to T port 19 in control position 47*b*, resulting in an unpressurized hydraulic line 32 and unpressurized locking gate 36, whereby locking pin 33 remains engaged in locking gate 36. Deviating from control position 47*a*, the first piston position, which provides a closed B port 21, B port 21 is also connected to the tank via T port 19 in control position 47*b*. In first control position 47*a*, B port 21 is closed, so that the oil does not flow out of camshaft adjuster 1 back into the tank in the start phase of the internal combustion engine when camshaft adjuster 1 is being filled. This results in increased pressure medium or oil leaks, which prevent a necessary, short-term pressure buildup within the internal combustion engine. Compared to previous approaches, A port 20 and the B port are reversed for the starting strategy according to the present invention, so that camshaft adjuster 2 adjusts to ADVANCE in second control position 47*b* of switching valve 17. In the previous circuit, camshaft adjuster 1 would have adjusted to RETARD and thus not in the direction of the central locking position (CLP).

Based on the new starting strategy, camshaft adjuster 1 is able to adjust only to up the central locking position, where it locks due to the engagement of locking pin 34. The internal combustion engine may subsequently be started up. After a long standstill time, the oil pressure buildup within the internal combustion engine may be prolonged, whereby the adjusting operation is slightly delayed. The starting strategy according to the present invention may, however, also be applied here, since a delayed oil pressure buildup does not have a negative impact on the start operation.

Figure 2:
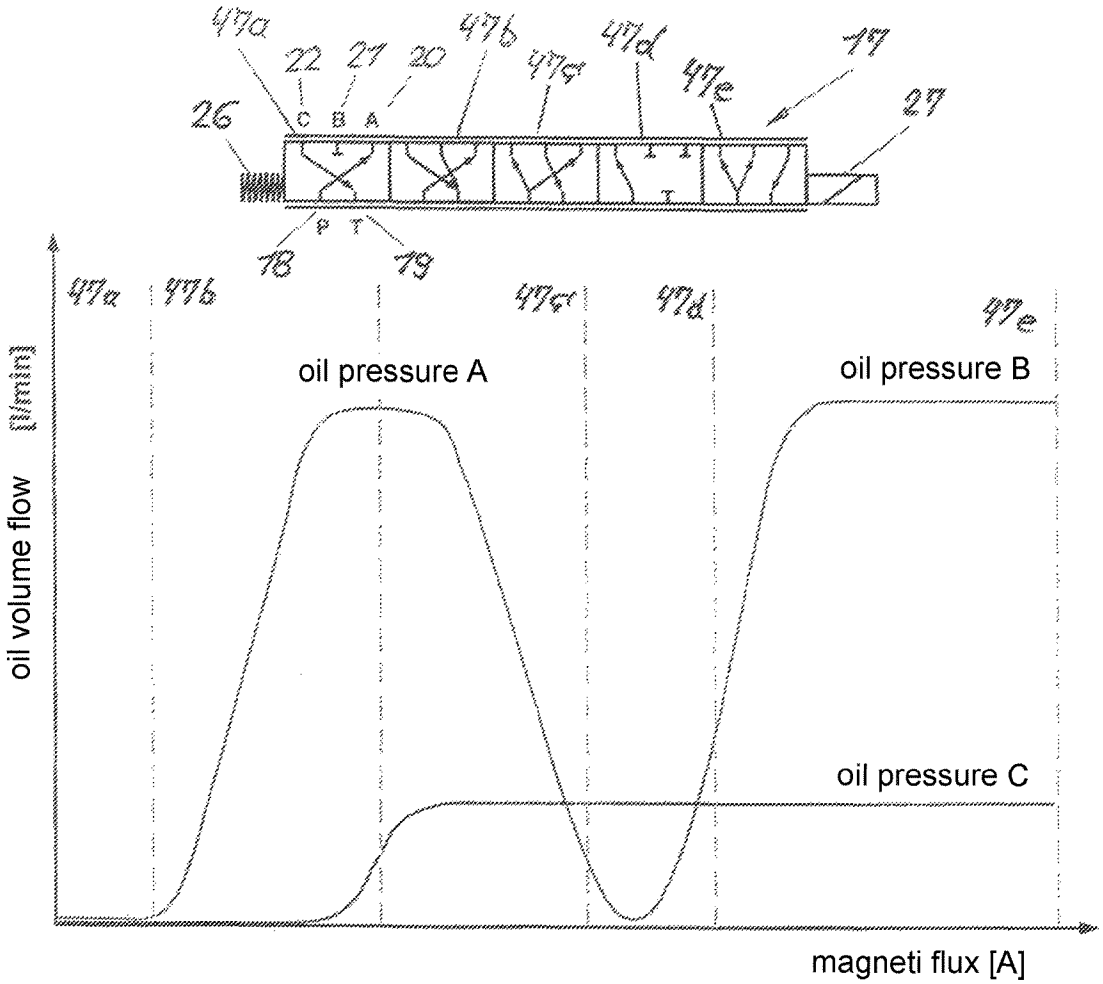
FIG. 2 shows a graph of the control characteristic and switching positions of a solenoid valve for a starting strategy of an internal combustion engine according to the present invention.

FIG. 2 shows a valve characteristic of switching valve 17 according to the present invention. In the graphical illustration, the magnetic flux (A) of the control element 27 used to adjust switching valve 17 is plotted on the abscissa, and the volume flow (1/min.) of the oil, which is referred to as hydraulic or pressure medium, is plotted on the ordinate. Based on additional control position 47*b*, a modified volume flow characteristic of the hydraulic medium sets in. In control position 47*b*, no oil yet flows into C port 22 and into hydraulic line 32 connected thereto. At the same time, B port 21 is connected to T port 19 and enables oil to be forced out of working chambers 12, 16 into the reservoir or into the tank via hydraulic line 31. As a result, the existing pressure present at A port 20 may be transferred to working chambers 13, 15 via hydraulic line 30 for the purpose of triggering an adjustment of camshaft adjuster 1 and consequently the timing of the gas exchange valves in the ADVANCE direction.

Figure 3:
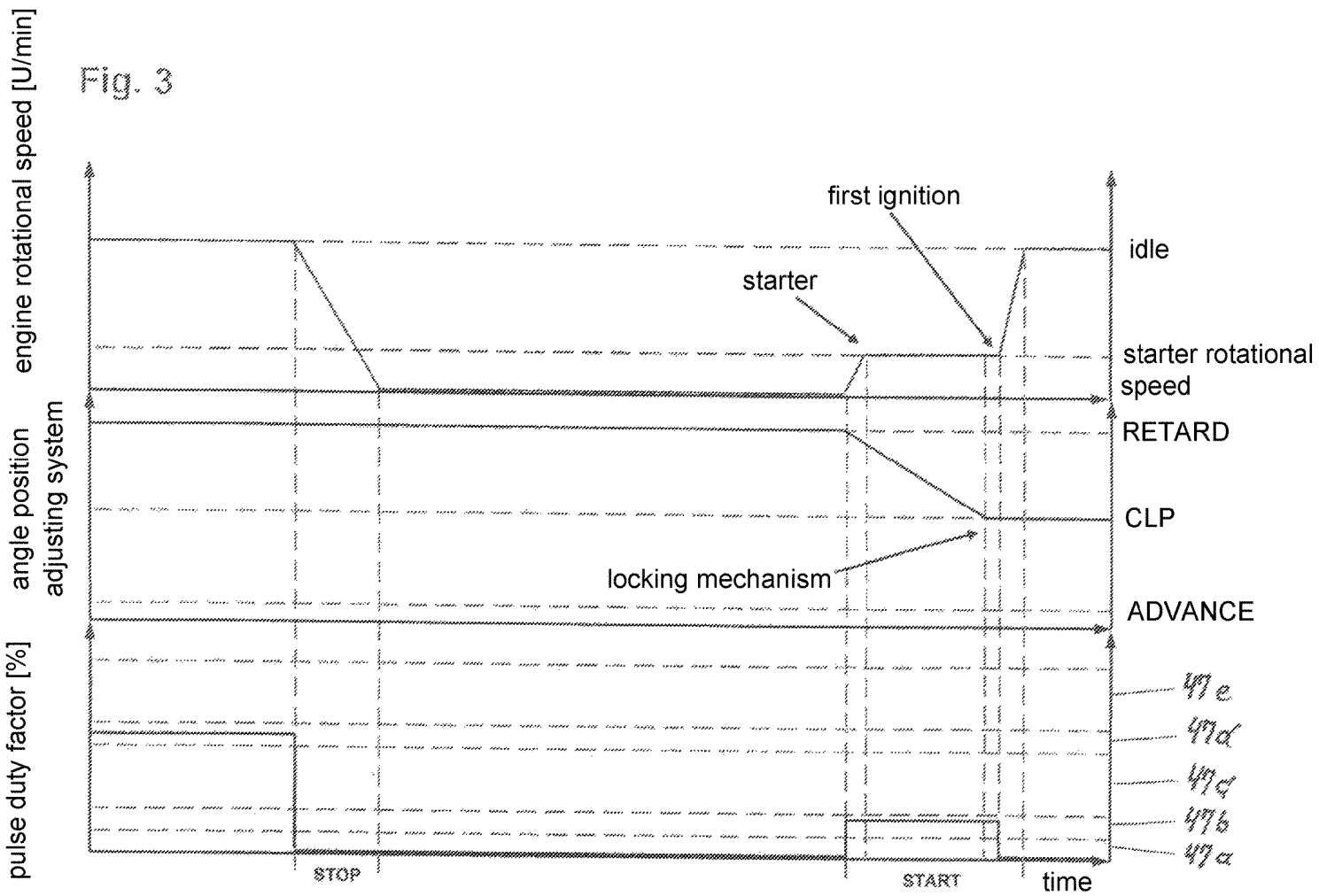
FIG. 3 shows a flow chart for the starting strategy according to the present invention.

A flowchart for the starting strategy of an internal combustion engine according to the present invention is illustrated graphically in FIG. 3. Three different line diagrams are combined vertically one above the other in such a way that the abscissa forms a time axis for all diagrams. The bottom line diagram shows a pulse duty factor (%) related to the different control positions 47*a* through 47*e* of switching valve 17. The course of the curve of the middle diagram relates to the angle position of the adjusting system of the camshaft (° CS). The top diagram shows the rotational speed curve (rpm) of the internal combustion engine.

LIST OF REFERENCE NUMERALS

1 camshaft adjuster
2 stator
3 rotor
4 rotor hub
5 vane
6 vane
7 vane
8 pressure chamber
9 pressure chamber
10 pressure chamber
11 working chamber
12 working chamber
13 working chamber
14 working chamber
15 working chamber
16 working chamber
17 switching valve
18 P port
19 T port
20 A port
21 B port
22 C port
23 control device
24 control device
25 control device
26 spring element
27 control element
28 line system
29 locking device
30 hydraulic line
31 hydraulic line
32 hydraulic line
33 locking pin
34 locking pin
35 receptacle
36 locking gate
37 hydraulic line
38 flow connection
39 flow connection
40 flow connection
41 check valve
42 check valve
43 spring element
44 control pin
45 control pin
46 control pin
47*a* control position
47*b* control position
47*c* control position
47*d* control position
47*e* control position

What is claimed is:

1. A hydraulic camshaft adjuster for changing timing of gas exchange valves of an internal combustion engine, configured as a vane camshaft adjuster, the camshaft adjuster comprising:

a stator configured to be connected to a crankshaft of the internal combustion engine;

a rotor rotatably fixedly supported in the stator and configured to be connected to a camshaft;

a line system supplying or discharging a hydraulic medium to or from at least two pressure chambers, a hydraulic switching valve connected therebetween, as well as with aid of pressure medium lines, the at least two pressure chambers each being divided into separate, oppositely acting working chambers by a rotor-fixed vane, a phase angle of the camshaft being selectively variable relative to the crankshaft;

a control device in the vane and configured to selectively unblock and interrupt a flow connection between the working chambers;

a locking device preventing a relative movement between the rotor and the stator, in that the rotor is fixed on the stator in a vane position, the interacting working chambers having a corresponding volume in the vane position;

the locking device including at least one locking pin locking in a central locking position of a locking gate from a direction of an ADVANCE or RETARD stop position during a rotation of the rotor;

the at least one locking pin being movable from a first switching position into a second switching position against a spring force by an application of the hydraulic medium;

the hydraulic switching valve including three working ports as well as a P port as an inlet and a T port as an outlet and being adjustable into different control positions via a control element;

in a first control position of the control positions, the P port and an A port communicating with the working chambers, a B port connected to the working chambers and being blocked at the switching valve, and the T port communicating with the control device of the vane via a C port;

in a second control position of the control positions, the P port communicating with the working chambers via the A port, the B port communicating with the working chambers, and the T port as well as the C port communicating with the control device of the vane and the T port;

in a third control position of the control positions, the A port and the B port being blocked at the switching valve, and the C port communicating with the P port and the control device of the vane; and in a fourth control position, the A port communicating with the T port and the working chambers, the B port communicating with the P port and the working chambers, and the C port communicating with the P port and the control device of the vane, the switching valve being switchable into a further control position during a starting strategy, the A port communicating with the P port and the working chambers, the B port communicating with the T port and the working chambers, and the C port communicating with the control device of the vane and the P port in the further control position.

2. The camshaft adjuster as recited in claim 1 wherein the starting strategy is applicable in an event that the camshaft adjuster is not locked in a central locking position in a start phase of the internal combustion engine, and an angle position sets in between the central locking position and a RETARD end stop.

3. The camshaft adjuster as recited in claim 1 wherein the B port of the hydraulic switching valve is in a position between the A port and the C port.

4. The camshaft adjuster as recited in claim 1 wherein the at least one locking pin includes first and second locking pins, the first locking pin being provided for locking in an ADVANCE direction and the second locking pin being provided for locking in a RETARD direction.

5. The camshaft adjuster as recited in claim 4 wherein the first locking pin interrupts the hydraulic medium flowing in a hydraulic line to the working chambers in a position extended out of the rotor.

6. The camshaft adjuster as recited in claim 4 wherein the second locking pin interrupts the hydraulic medium flowing in a hydraulic line to the working chambers in a position extended out of the rotor.

7. The camshaft adjuster as recited in claim 1 further comprising a spring element displacing the at least one locking pin of the locking device out of the rotor when a counter-force acting upon the at least one locking pin is absent.

8. The camshaft adjuster as recited in claim 1 further comprising at least one further vane assigned to the at least two pressure chambers, the rotor fixed vane and the further vane each assigned to the at least two pressure chambers in a symmetrically distributed manner.

* * * * *